United States Patent [19]

Trail

[11] Patent Number: 4,938,312

[45] Date of Patent: Jul. 3, 1990

[54] LADDER RIDGE HOOK AND STAND OFF

[76] Inventor: Thomas E. Trail, 803 4th St., Radford, Va. 24141

[21] Appl. No.: 422,609

[22] Filed: Oct. 17, 1989

[51] Int. Cl.[5] ..... E06C 7/06; E06C 7/48

[52] U.S. Cl. ..... 182/206; 182/209; 182/214

[58] Field of Search ..... 182/206, 214, 209, 45

[56] References Cited

U.S. PATENT DOCUMENTS

| | | | |
|---|---|---|---|
| 198,897 | 1/1978 | Middleton . | |
| 363,634 | 5/1887 | Harris | 182/206 |
| 818,268 | 4/1906 | Leuz | 182/209 |
| 1,004,284 | 9/1911 | Lehmann | 182/214 |
| 1,035,770 | 8/1912 | Blair | 182/209 |
| 1,233,717 | 7/1917 | Shinn | 182/206 |
| 1,249,855 | 12/1917 | Taylor | 182/206 |
| 1,519,025 | 12/1924 | Fairfield . | |
| 2,803,388 | 8/1957 | Ross . | |
| 4,121,692 | 10/1978 | Morawski . | |
| 4,179,011 | 12/1979 | Morawski . | |
| 4,311,207 | 1/1982 | Lurry | 182/206 |
| 4,397,375 | 8/1983 | Hart . | |
| 4,458,783 | 7/1984 | Stakes . | |
| 4,531,612 | 7/1985 | Sandor | 182/206 |
| 4,787,478 | 11/1988 | Stakes | 182/214 |

*Primary Examiner*—Reinaldo P. Machado

*Attorney, Agent, or Firm*—Kerkam, Stowell, Kondracki & Clarke

[57] ABSTRACT

A device which may serve as a ridge hook for hooking a ladder unto a ridge of a roof includes two wheels mounted upon arms. A threaded rod extends through the hollow core of a ladder rung to secure the device to a ladder. An unhooking arrangement uses a pivot arm, normally biased to be parallel to the ladder, to lift an upper end of the ladder free of the ridge when a control line is pulled. A ladder rung lock is used to prevent relative movement between the upper and lower sections of an extension ladder.

20 Claims, 3 Drawing Sheets

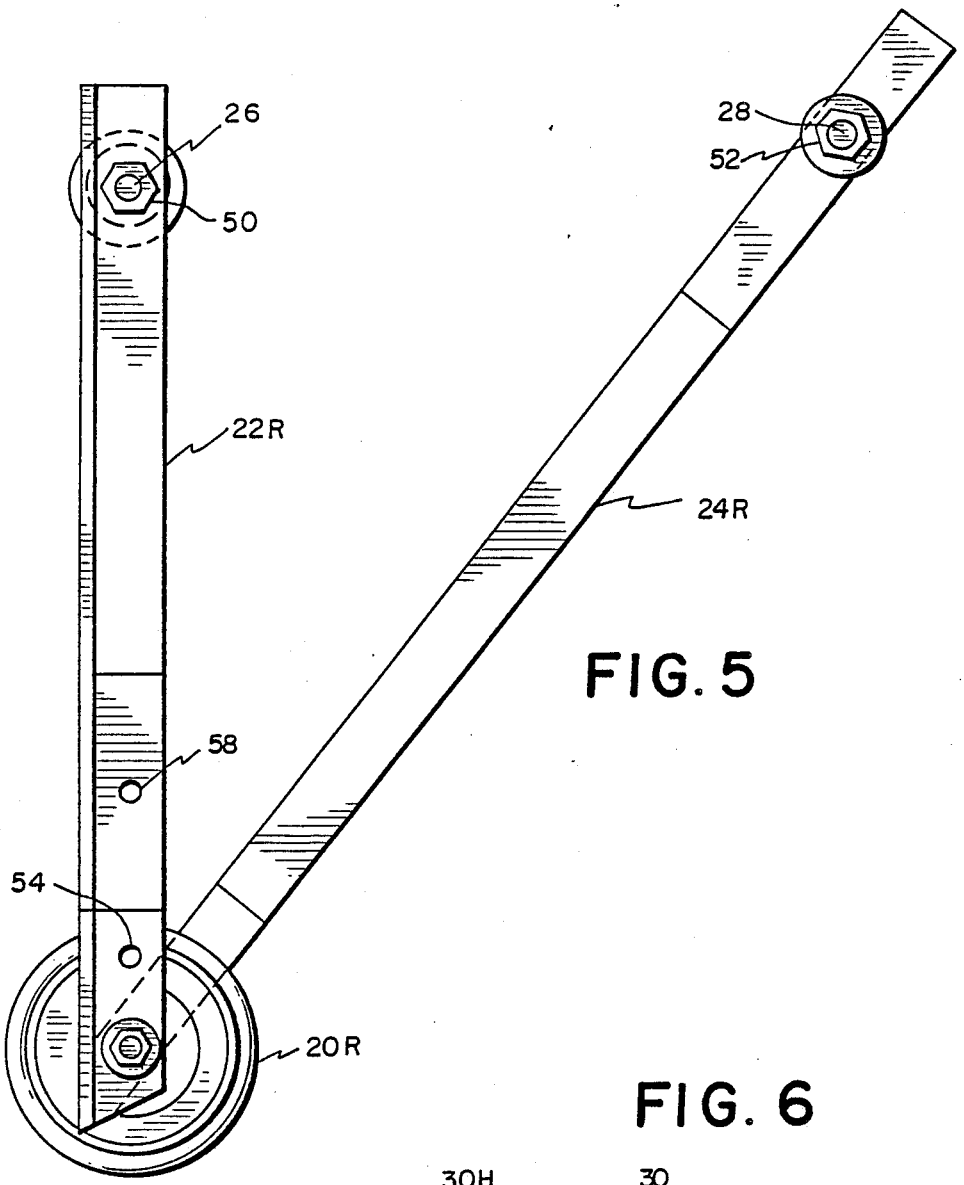
FIG. 5
FIG. 6
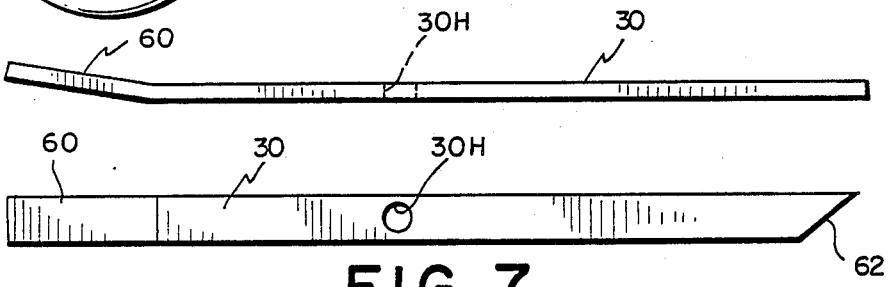
FIG. 7

LADDER RIDGE HOOK AND STAND OFF

BACKGROUND OF THE INVENTION

This invention relates to a device serving as a ridge hook and a stand off for use with a ladder.

Homeowners are often required to use ladders outside their house for maintaining their house. For example, homeowners often must climb up ladders placed against the side of their house in order to clean the gutters or perform other work such as painting the house. Additionally, homeowners are often required to walk upon the roof of the house for inspection or repair purposes. In similar fashion, workers and companies engaged in performing various services for homeowners often must place ladders against the outside of a house and/or perform work on the roof.

There are a number of problems which often occur when performing work on or adjacent to a roof of a house. Placing the ladder at the side of a house may cause the ladder to deform or damage the gutters. Alternately, the ladder may deform or damage the edge of the shingles. If one is working on the side of a house, the ladder may damage the siding or other external surface on the side of the house.

To avoid damaging the roof, it is recommended that homeowners or workers minimize their walking upon the roof. However, it is often necessary to work on the roof in order to make repairs, install antennas or perform other tasks. Further, depending upon the pitch of the roof surface, a person may feel ill at ease walking upon the surface. Finally, people have been injured by falling over the edge of the roof.

In addition to injuries from falling off the edge of a roof, people are often injured due to slippage of a ladder placed against the side of a house.

OBJECTS AND SUMMARY OF THE INVENTION

Accordingly, it is a primary object of the present invention to provide a new and improved device which may serve as a ridge hook and/or stand off.

A more specific object of the present invention is to provide such a device which may easily allow one to work along side a house or other building without damaging shingles, gutters, siding, or other portions of the building structure.

A further object of the present invention is to provide such a device which will allow one to more safely use a ladder against a side of a building.

Yet another object of the present invention is to provide such a device which allows one to hook a ladder to the ridge of a house such that one may move along the roofing surface by movement along the ladder and maximize the safety of the person working on the roof while minimizing the likelihood of damage to the shingles or other roofing materials.

A still further object of the present invention is to provide such a device which is relatively simple in construction, light in weight, and low in cost.

The above and other objects of the present invention which will become more apparent as the description proceeds are realized by a ridge hook device for a ladder. The device comprises two arms, each having an upper end with means for attachment to a ladder, two wheels, each mounted to a lower end of a corresponding one of the arms, the wheels and the arms securable in a position relative to a ladder to hook a ladder to a ridge of roof, and unhooking means extending from adjacent the arms to a location remote from the arms and operable to unhook a ladder from a location near the lower end of a ladder. The arms spread out such that the lower ends of the ends are further apart than the upper ends. The device also includes means to lock the wheels against rotation. Two braces have lower ends attached to corresponding ones of the wheels. Upper ends of the braces have means for attachment to a ladder. The means for attachment of the brace upper ends includes a rod extendable through a hollow rung of a ladder. The means for attachment of the arm upper ends includes a rod extendable through a hollow rung of a ladder. The unhooking means includes a pivot arm and a control line attached to pivot the pivot arm such that a ladder can be unhooked from a ridge. A spring biases the pivot arm towards a position to avoid contacting a roof. The pivot arm pivots against the bias of the spring to contact a roof when the control line is pulled. A ladder rung lock includes first and second portions, each of the portions fitting within a hollow rung of a ladder and means to secure the portions relative to different sections of an extension ladder such that the different sections are secured against relative movement. The first and second portions are both part of a common member having a bend at a closed side and first and second ends at an open side and the means to secure includes a member attachable to the first and second ends to close the open side.

BRIEF DESCRIPTION OF THE DRAWINGS

The above and other features of the present invention will be more readily understood when the following detailed description is considered in conjunction with the accompanying drawings where in like characters represent like parts throughout the several views and in which:

FIG. 5 shows a side view of the assembly of FIG. 4;

FIG. 6 shows a front view of a pivot arm used with the present invention; and

FIG. 7 shows a side view of the pivot arm of FIG. 6.

DETAILED DESCRIPTION

Figure 1:
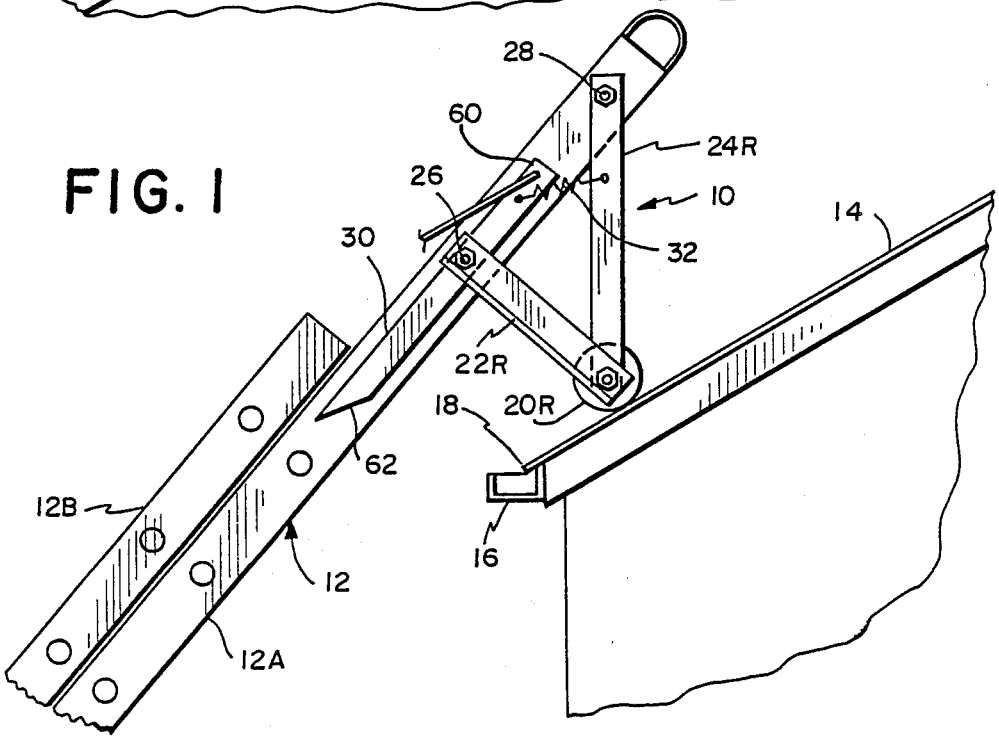
FIG. 1 is a simplified side view of the present invention serving as a stand off for a conventional extension ladder placed at side of a house or other building.

With reference now to FIG. 1, the device 10 of the present invention is shown attached to a conventional extension ladder 12 having an upper section 12A and a lower section 12B which would be slidable relative to each other in a known fashion. As shown in FIG. 1, the device 10 is serving as a stand off to separate the ladder 12 from a roofing surface 14 which may be the roof a house or other building. The device 10 prevents the ladder 12 from deforming and/or damaging the gutter 16. Additionally, and in the absence of a gutter such as 16, the device 10 will hold the ladder 12 apart from the surface 14 so that shingles (not separately shown) at the edge 18 would not be deformed or damaged by the ladder 12.

The device 10 has a wheel 20R which is mounted upon an arm 22R and also braced by brace 24R. Wheel 20R, arm 22R, and brace 24R are located at the right side of the ladder 12, it being understood that the notation R after the numeral of a component indicates that it is a component having a corresponding left side component on the left side of the ladder 12. The lower ends of the arm 22R and brace 24R support the wheel 20R and allow it to rotate except when locked in position as discussed below. The upper ends of the arm 22R and the brace 24R are bolted to corresponding threaded rods 26 and 28 which extend through hollow rungs of the upper section 12A of ladder 12 and are bolted or otherwise secured to left side parts symmetrical in structure to the arm 22R and brace 24R.

A pivot arm 30 is pivotably mounted to the threaded rod 26 and is biased by spring 32 to normally extend parallel to upper section 12A of ladder 12. The pivot arm, which may be considered to be in a retracted position in FIG. 1, is not used when the device 10 is serving as a stand off, but is used when the device 10 is hooking a ladder to a ridge in the manner described below.

Figure 2:
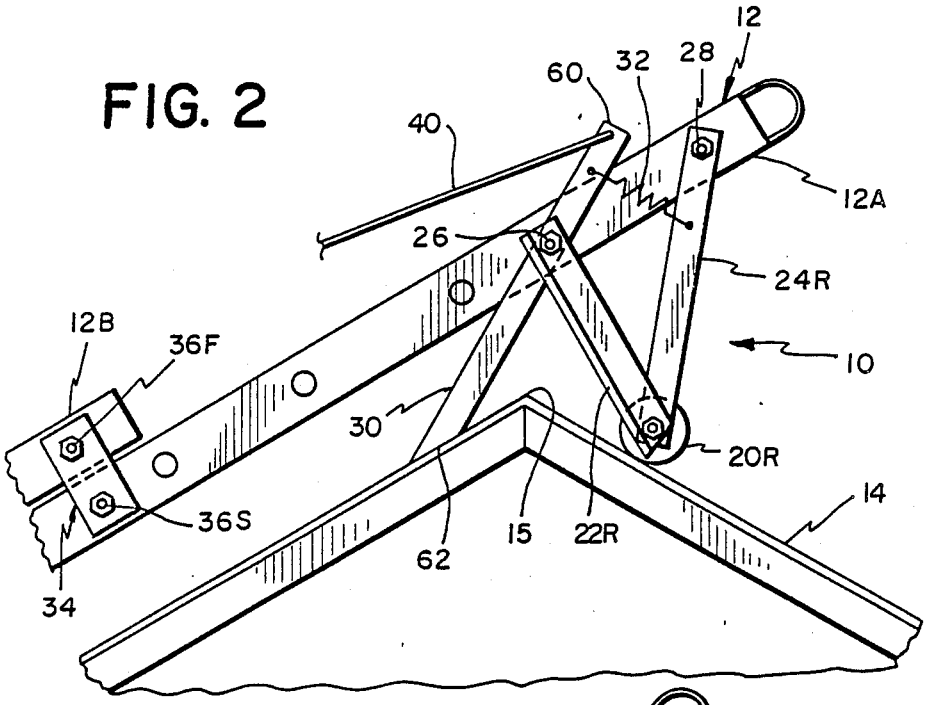
FIG. 2 shows the present device attached to a ladder and used as a ridge hook.

With reference now to FIG. 2, the device 10 is configured as a ridge hook hooking the top of ladder 12 to the ridge 15 of roof 14. Specifically, the wheel 20R, arm 22R, and brace 24R (together with the corresponding left side parts, not visible) are on one side of the ridge whereas the lower end of pivot arm 30 and the lower end of the ladder 12 itself are on the other side of the ridge 15.

Figure 3:
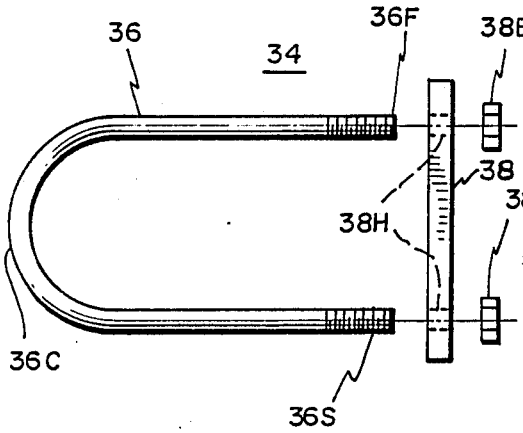
FIG. 3 shows a planar view of a ladder rung lock arrangement.

When the device 10 is used as a ridge hook in the manner shown in FIG. 12, the device 10 of the present invention would also include a ladder rung lock 34. Continuing to consider the view of FIG. 2, but also considering FIG. 3, the ladder rung lock 34 includes a member 36 having first and second ends 36F and 36S. The ends 36F and 36S are placed through the hollow rungs of different sections of a conventional extension ladder until the closed end 36C is up against one side of the extension ladder whereupon a locking plate 38 is placed over the ends 36F and 36S with the portions of member 36 extending through holes 38H shown in phantom view in FIG. 3. The locking plate 38 is then secured to the side of the ladder 12 opposite the side against which the closed end 36C abuts with the nuts 38B fixing the locking plate to the member 36. (Washers, not shown, could be used against the nuts 38B.)

The rung lock 34 avoids having relative movement between the upper section 12A and lower section 12B of ladder 12.

Although most conventional extension ladders 12 having an upper section 12A and 12B have a known arrangement (not shown) to avoid having relative movement between the sections 12A and 12B when the ladder is in operation, such arrangements generally assume that the foot of the lower section 12B of the ladder is resting upon the ground. Such arrangements generally prevent a downward load on the upper ladder section 12A from causing the upper section 12A to move down relative to the lower section 12B. However, such arrangements generally allow one to easily move the upper section upward relative to the lower section 12B without special procedures.

When the ladder 12 is secured at its upper end, as shown in FIG. 2, the conventional arrangements to prevent the top section 12A from sliding downward relative to the bottom section 12B would not prevent the bottom section 12B from sliding down relative to the top section 12A. In other words, a person who climbed upon the lower section 12B of a conventional ladder 12 when the ladder is secured at its upper end, but unsecured at its lower end, would risk serious injury in that the lower section 12B could slide downward under the person's weight. In order to avoid such sliding of the lower section 12B relative to the upper section 12A, the device 10 includes the ladder rung lock 34. Although various materials and constructions could be used, the member 36 is preferably ½ cold roll steel and the plate 34 is preferably ¼ thick cold roll steel.

Before discussing specific construction details with respect to various parts of the invention, a brief overview of the invention operation for performing a repair on the roofing surface 14 may be useful. The ladder 12 is placed against the side of the house in the position shown in FIG. 1 and the person may climb up and get on top of the house. The present invention improves safety as there would be at least two rungs above the roof such that the person may step off onto the roof. The person having climbed off the ladder may then move the ladder to the desired location at the ridge 15 with the wheel 20R and a corresponding left side wheel (not shown) aiding in this process. Depending upon the length of ladder which is required, the ladder rung lock 34 may have been previously attached to the ladder 12 or it may be attached when the person is upon the roof. Although the lock 34 is shown in FIG. 2 at the upper end of lower ladder section 12B, the lock 34 could be placed anywhere that the two ladder sections overlap. The person may now climb upon the ladder 12 as it extends almost parallel to one side of the roofing surface 14 and in the position of FIG. 2 wherein the upper end of ladder 12 is supported by one side of the roofing surface 14 and the lower end of the ladder would be supported by an opposite side of the roofing surface 14 (i.e., on the other side of ridge 15). The person may now easily work along the ladder using the ladder for support and/or security purposes. Repairing shingles, working on a TV antenna or various other jobs are made easier and/or safer. When the person is ready to take the ladder down, he may simply go to the lower end of the ladder and pull on a rope 40 which is attached to a hole at the upper end of member 30 and which would extend to adjacent a lower end (not shown) of the ladder. By pulling on the rope 40, the pivot arm 30 pivots against the bias of the spring 32 and causes the wheels such as 20R to ride up and over the ridge 15 whereupon the person may slowly lower the ladder by allowing the ladder to roll along the wheels of device 10. Once the ladder has cleared the ridge, the bias of spring 32 pulls the pivot arm 30 (now that the person has released rope or control line 40) to its retracted position parallel to the ladder such that pivot arm 30 will not hinder movement of the ladder.

Figure 4:
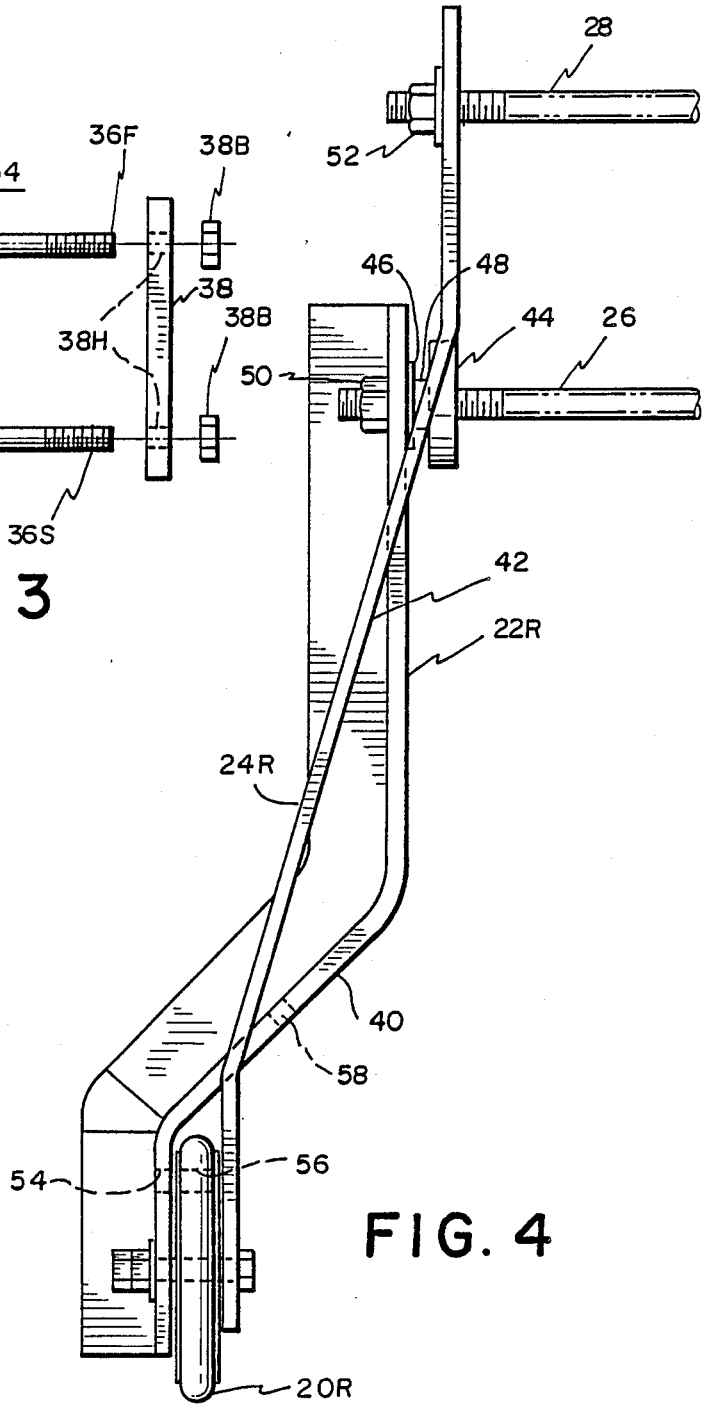
FIG. 4 shows a front view of a right hand assembly used with the present invention.

As shown in FIG. 4, both the brace 24R and the arm 22R spread out such that the distance between the upper ends of each of these components and the corresponding upper ends of the symmetrical left components (not shown) are closer together than the lower ends. For example, the distance between the upper ends of the illustrated right arm and the upper end of the not shown left arm might be 16 inches, but the distance between the lower ends of the arms would be 24 inches by use of the 45° angle portion 40. In similar fashion, the braces such as 24R include a angled portion 42 which allows the spreading of the braces. The spreading of the arms and braces allows the wheel 20R and a corresponding left side wheel to have a greater separation distance than the width of the ladder in order to provide added stability. Advantageously the upper ends of the arms such as 22R has a T shaped washer 44 and a flat washer 46 attached to the threaded rod 26 to provide a sleeve portion 48 such that the pivot arm (not shown in FIG. 4) may be mounted for pivoting thereon.

The upper end of the arms such as 22R will be secured to a ladder by nut 50 combined with the washers and threaded rod 26. The upper ends of the braces such as 24R are secured to a threaded rod 28 by bolt 52. Advantageously, the threaded ladder rung (not shown in FIG. 4) such that the present device will readily mount to a ladder without any drilling or other alteration of the ladder. Additionally, by extending through the ladder rungs, the present device avoids having portions which would interfere with a person climbing up the ladder. In other words, the only portions of the device which are within the side rails of the ladder are the portions which are internal to the ladder rungs.

The nut 52 and threaded rod 28, together with an illustrated washer, serve as a means for attaching the upper ends of the brace 24R.

With reference now also to FIG. 5, a hole 54 in the arm 22 together with a hole 56 serves as a means for securing the wheel 20R against rolling. More specifically, a clevis pin (not shown) may be extended through the holes 54 and 56 to lock the wheel in place with a hitch pin (not shown). The clevis pin may normally be stored in the hole 58 with the hitch pin fixed thereto.

With reference now to FIG. 6, the pivot arm 30 includes a hole 30H which is rotatably mounted at the sleeve portion 48 (refer back momentarily to FIG. 4). The upper end 60 of the pivot arm 30 is tilted at an angle of about 10° relative to the remainder of the planar pivot arm 30. Specifically, the upper end 60 of the pivot arm is inclined out of the plane of view of FIGS. 1 and 2 such that the pivot arm 60 will not interfere with the brace 24R. Additionally, the lower end of brace 30 includes an inclined surface 62 (best shown in FIG. 7). The inclined surface 62 is used to generally conform to the incline of a roofing surface 14 as best shown in FIG. 2.

Although various materials could alternately be used, the braces may be 1⅛" thick aluminum, whereas the arms may be 1 and ½ inch angle aluminum.

In addition to its use as a ridge hook and stand off as shown in FIG. 1, the device 10 could be used to stand off a ladder from a side of a house.

Although various specific constructions and details have been described herein, it is to be understood that these are for illustrative purposes only. Various modifications and adaptations will be apparent to those of skill in the art. Accordingly, the scope of the present invention should be determined by reference to the claims appended hereto.

What is claimed is:

1. A ridge hook device for a ladder comprising:
   two arms, each having an upper end with means for attachment to a ladder;
   two wheels, each mounted to a lower end of a corresponding one of said two arms, said wheels and said arms securable in a position relative to a ladder to hook a ladder to a ridge of a roof; and
   unhooking means extending from adjacent said arms to a location remote from said arms and operable to unhook a ladder from a location near the lower end of a ladder.

2. The device of claim 1 wherein said arms spread out such that their lower ends are further apart than said upper ends.

3. The device of claim 1 further including means to lock said wheels against rotation.

4. The device of claim 1 further comprising two braces, each having a lower end attached to a corresponding one of said wheels and an upper end with means for attachment to a ladder.

5. The device of claim 4 wherein said means for attachment of said brace upper ends includes a rod extendable through a hollow rung of a ladder.

6. The device of claim 4 wherein said means for attachment of said arm upper ends includes a rod extendable through a hollow rung of a ladder.

7. The device of claim 1 wherein said means for attachment of said arm upper ends includes a rod extendable through a hollow rung of a ladder.

8. The device of claim 1 wherein said unhooking means includes a pivot arm and a control line attached to pivot said pivot arm such that a ladder can be unhooked from a ridge by a person remote from the ridge pulling on the control line.

9. The device of claim 8 further comprising a spring biasing said pivot arm towards a position to avoid contacting a roof and wherein the pivot arm pivots against the bias of the spring to contact a roof when the control line is pulled.

10. The device of claim 8 further comprising a ladder rung lock including first and second portions, each of said first and second portions fitting within a hollow rung of a ladder, and means to secure said portions relative to different sections of an extension ladder such that the different sections are secured against relative movement.

11. A device for serving as a ridge hook for a ladder comprising:
   two arms, each having an upper end with means for attachment to a ladder;
   two wheels, each mounted to a lower end of a corresponding one of said two arms, said wheels and said arms securable in a position relative to a ladder to hook a ladder to a ridge of a roof; and
   a ladder rung lock including first and second portions, each of said first and second portions fitting within a hollow rung of a ladder, and means to secure said portions relative to different sections of an extension ladder such that the different sections are secured against relative movement.

12. The device of claim 11 wherein said first and second portions are both part of a common member having a bend at a closed side and having first and second ends at an open side and said means to secure includes a member attachable to said first and second ends to close said open side.

13. The device of claim 12 further comprising:
   unhooking means extending from adjacent said arms to a location remote from said arms and operable to unhook a ladder from a location near the lower end of a ladder.

14. The device of claim 13 wherein said arms spread out such that their lower ends are further apart than said upper ends.

15. The device of claim 14 further including means to lock said wheels against rotation.

16. The device of claim 15 further comprising two braces, each having a lower end attached to a corresponding one of said wheels and an upper end with means for attachment to a ladder.

17. The device of claim 16 wherein said means for attachment of said brace upper ends includes a rod extendable through a hollow rung of a ladder.

18. The device of claim 11 wherein said means for attachment of said arm upper ends includes a rod extendable through a hollow rung of a ladder.

19. The device of claim 11 further comprising two braces, each having a lower end attached to a corresponding one of said wheels and an upper end with means for attachment to a ladder.

20. The device of claim 11 wherein said arms spread out such that their lower ends are further apart than said upper ends.

* * * * *